United States Patent [19]

Leibe

[11] Patent Number: 4,770,337

[45] Date of Patent: Sep. 13, 1988

[54] WEB-TYPE MULTIPLE-PART BUSINESS FORM STOCK HAVING PRE-GLUED BUT NON-ADHERED CROSS-WEB HEAT SEAL GLUE LINES DESIGNED FOR ACTIVATION TO SEAL OUTGOING ENVELOPES AFTER PRINTING-TYPE PERSONALIZATION OF POTENTIAL FROMS THEREOF

[75] Inventor: Stephen A. Leibe, Coopersburg, Pa.

[73] Assignee: Moore Business Forms, Inc., Glenview, Ill.

[21] Appl. No.: 79,993

[22] Filed: Jul. 31, 1987

[51] Int. Cl.[4] ..... B65D 77/10

[52] U.S. Cl. ..... 229/69; 229/73

[58] Field of Search ..... 229/69, 73, 92, 92.1, 229/68 R

[56] References Cited

U.S. PATENT DOCUMENTS

| | | | |
|---|---|---|---|
| 3,905,545 | 9/1975 | Juszak et al. | 229/69 |
| 4,081,127 | 3/1978 | Steidinger | 229/73 |
| 4,343,430 | 8/1982 | Martineau | 229/69 |
| 4,361,269 | 11/1982 | Neubauer | 229/69 |

OTHER PUBLICATIONS

Specimen of Speedimailer® Business Form Stock, Available from Moore Business Forms, Inc.

*Primary Examiner*—Willis Little

*Attorney, Agent, or Firm*—Cushman, Darby & Cushman

[57] ABSTRACT

In a web-type multiple-part business form stock having a succession of serially connected potential outgoing envelopes each containing one or more intermediate layers which may be withdrawn from the outgoing envelopes after the outgoing envelopes are received and opened by an addressee, the hitherto conventionally-used cross-web lines of cold glue used for defining the two opposite edges of the internal spaces of the potential outgoing envelopes is replaced by cross-web band patterns of hot melt adhesive applied in a customary location, but left attached only to the web surface to which it was applied, and which is not heat activated and used to adhere the respective webs together until after the form stock has been variably printed by the form manufacturer's customer, e.g. by an impact printer used in association with a carbon-type or carbonless between-layers coating provided internally of the form stock.

14 Claims, 4 Drawing Sheets

RETURN THIS PORTION WITH YOUR PAYMENT

WEB-TYPE MULTIPLE-PART BUSINESS FORM STOCK HAVING PRE-GLUED BUT NON-ADHERED CROSS-WEB HEAT SEAL GLUE LINES DESIGNED FOR ACTIVATION TO SEAL OUTGOING ENVELOPES AFTER PRINTING-TYPE PERSONALIZATION OF POTENTIAL FROMS THEREOF

BACKGROUND OF THE INVENTION

A widely-used type of business communication is a multiple-part form which, as received by an addressee, comprises a sealed outgoing envelope containing contents, and bearing instructions for opening the outgoing envelope for gaining access to the contents. Often this involves tearing of an end of the sealed outgoing envelope along a line of weakness, then pulling on opposite end margins of the opened envelope to withdraw the contents, along with two half-moon-shaped end pieces of the open end of the outgoing envelope. The contents come free because, if they are attached at all inside the outgoing envelope, they are attached only at one or both ends, but not along their long sides. Rather, on the sides, the contents are narrower than the space inside the envelope. Often that space is defined by two lines of glue which adhere the front and back sheets of the outgoing envelope to one another adjacent opposite long edges of the outgoing envelope. The outgoing envelope contents typically comprise one or more preprinted form parts at least one of which has been personalized by applying to it some customized printing, e.g. relating to a customer"s account. The contents further typically include an open, pre-addressed return envelope, and instructions for making payment by enclosing a check or other form of payment in the return envelope together with all or part of at least one of the form parts, closing and sealing the return envelope, attaching postage, and mailing this assembly to the return envelope send-to addressee. A generic term by which such a multiple-part form is known in the trade is a "mailer".

The term "parts" of a form could refer to two different entities. It could refer to separable sub-assemblies of a form, and the term is sometimes used in that way. At other times, it is used for referring to the number of layers of sheet stock which are assembled to create the form whether and regardless of to what extent these layers of sheet stock are adhered or otherwise connected to one another either by the form stock manufacturer or by its customer, the sender of the outgoing envelopes. The term is used in its latter sense in this document.

One popular method used for manufacturing form stock of multiple-part mailers is to provide a plurality of webs, which are considerably longer than broad, at least some of these webs having a row of drive sprocket-receiving holes along one or both lateral margins. As the webs are advanced, various operations are performed on them at various stations, including printing, longitudinal and transverse perforating, longitudinal and transverse gluing die-cutting, application of strips or spots of carbon-coating, glassine window patches, and the like. In the course of performing this processing, portions of some webs may be cut away, or some of those webs may be cut into a succession of segments, so that when the various layers are stacked and pressed together to assemble the form stock, some layers are effectively discontinuous lengthwise of the composite web. For instance, between outer continuous web-type layers which bear a repeating pattern of cross-web between webs glue line, adjacent cross-web perforation, adjacent cross-web between webs glue line, long space, and repeat, layers are interleaved in the space regions, which are discontinuous longitudinally of the composite web from one such space to the next, thereby providing contents for the potential outgoing envelopes. The outer web layers which define the fronts and backs of the outgoing envelopes are attached to one another along between web longitudinal glue lines adjoining the opposite lateral margins of the respective webs. These glue lines may attach one of these webs directly to the other, or indirectly to one another via respective portions of intervening webs or web portions provided with further longitudinal glue lines.

The composite form stock resulting from such a manufacturing operation could be supplied to the form stock manufacturer's customers in many physical forms. A popular one which is perhaps most often requested is one in which the stock is repeatedly folded back on itself along the horizontal perforation lines adjoining which, later on, separate mailers will be created by perforation line severance. Although such a zig-zag folding could be accomplished using every such perforation line as a fold line, in practice, the folding is practiced only on every second or every third or every fourth such fold line, with the resulting accordion-folded composite being accumulated in a shipping carton, neatly occupying the full width and depth of the carton. When the carton is full, the composite web is severed and filling of a new box is begun, as the full box is closed, sealed and stored or shipped to a customer.

At the customer's facility (or at the facility of a service organization acting on behalf of the customer), the box is opened and the lead end of the composite web is fed into a machine, e.g. a computer-driven variable printer, which successively customizes each potential mailer of the composite web, e.g. by applying a customer's name, account number, address, and information about goods or services provided, amounts due, amounts paid, due dates, membership information and/or the like.

This information, to the extent it is applied to layers already located internally of what will become the outgoing envelopes, typically is printed using a combination of an impact printer, and either carbon coatings on some or all of some layers, interleaves of carbon paper between some or all of some layers, or carbonless copy-making coatings of either the two facing layer type or of the self-contained type on some or all of some layers.

A particularly well-known product of the type just described is the Speedimailer® business form stock available in the United States from Moore Business Forms, Inc.

In such product, the glue which is conventionally used for providing each set of two cross-web glue lines that will define the long sides of the internal space of each outgoing envelope is what is conventionally termed a "cold" glue, meaning that when it is applied, it is, or soon becomes, active without needing to be heated.

For many customers, such preassembled, pre-adhered form stock is a godsend, and "the best thing since sliced bread", but there are others who see drawbacks which they subject to criticism. The present invention was developed as a response to such criticism, in the hopes of more fully satisfying a further segment of the potential market for the form stock.

In the prior art Speedimailer® construction, a part of the normal construction method involved cold-gluing the face of the last sheet in the assembly to the back of the outgoing address sheet, as well as stream gluing left and right sides. Between these two sheets were the required number of die cut inserts; i.e., inserts which were cutback from the marginal edges at the top and bottom of the form. This construction method produced a substantial amount of "tenting" because the cold glue would setup after the forms were packaged. This tenting problem has heretofore been alleviated by various measures, such as die-cutting the inserts to reduce the bulk of the form at the fold perforations.

SUMMARY OF THE INVENTION

In a web-type multiple-part business form stock having a succession of serially connected potential outgoing envelopes each containing one or more intermediate layers which may be withdrawn from the outgoing envelopes after the outgoing envelopes are received and opened by an addressee, the hitherto conventionally-used cross-web lines of cold glue used for defining the two opposite edges of the internal spaces of the potential outgoing envelopes is replaced by cross-web band patterns of hot melt adhesive applied in a customary location, but left attached only to the web surface to which it was applied, and which is not heat activated and used to adhere the respective webs together until after the form stock has been variably printed by the form manufacturer's customer, e.g. by an impact printer used in association with a carbon-type or carbonless between-layers coating provided internally of the form stock.

Using the principles of the present invention, manufacturing speeds have been varied from 100 forms per minute up to and including 170 forms per minute with optimum conditions about 160 forms per minute. This compares with an average of 110 forms per minute under normal manufacturing conditions. At the higher speeds, there has been no evidence of "tenting" as experienced with the cold glue method. This represents approximately a 45% increase in manufacturing speed.

One of the chief advantages of the present form is it can be processed on mini-printers with fewer problems of imaging. With the old cold glue method, air would sometimes become trapped within the mailer envelope causing an inflated "balloon" effect resulting in a splotchy print image. This problem was alleviated somewhat by punching holes in the outer envelope to permit the air to escape. With the present heat seal glue construction, the escape of air is no problem because the top and bottom of each form are open to permit the escape of air. In addition, heat sealing the form after it has been imaged enhances the carbonless imprinted image.

To "finish" the product the forms are passed through a detacher which separates the forms into individual units, and subsequently, the forms are passed through a heat sealer to activate the heat seal glue at the top and bottom of each form.

In various circumstances, there are up to four advantages provided by use of the present construction as opposed to the prior cold glue construction. These include:

(1) Improved manufacturing efficiency, including increased production speeds and better product quality.

(2) Expanded compatibility with various printer models because of decreased "tenting".

(3) Improved manifolding through the multiple parts of the form by eliminating air entrapment within the assembly.

(4) Improved carbonless printed image developement due to post-print heating operation using the heat sealer.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

IN THE DRAWING

Figure 1:
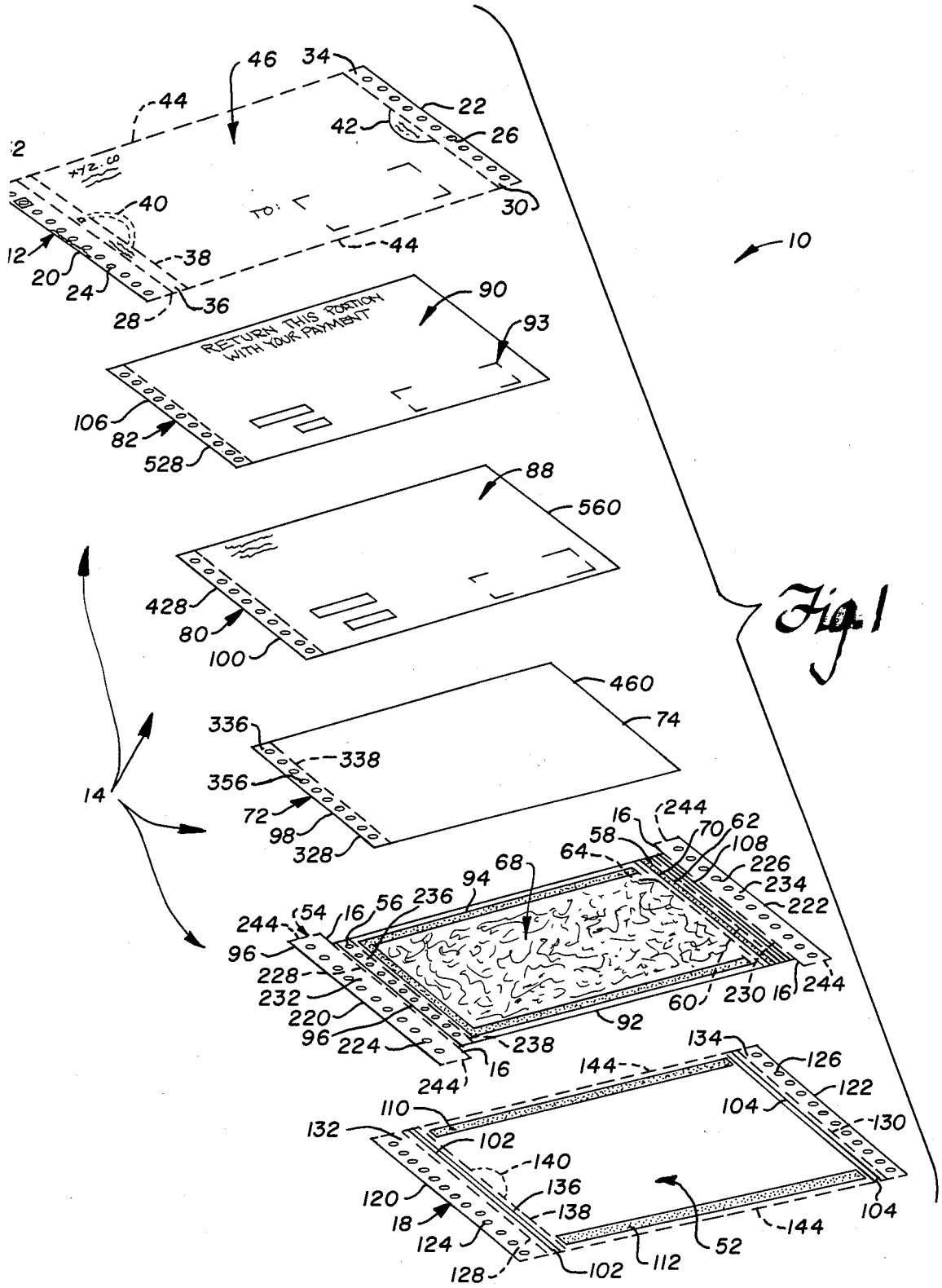
Figure 2:
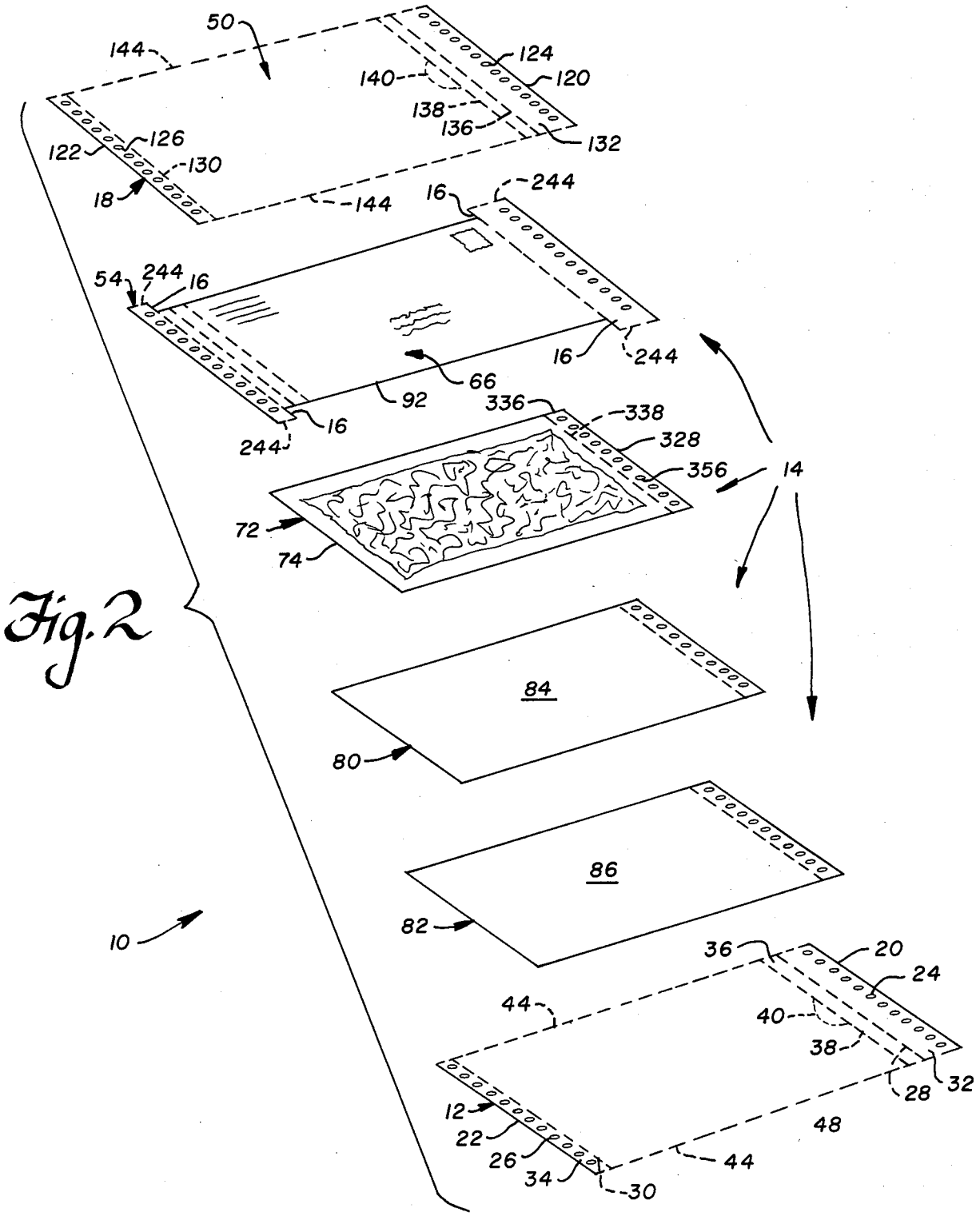
Figure 3:
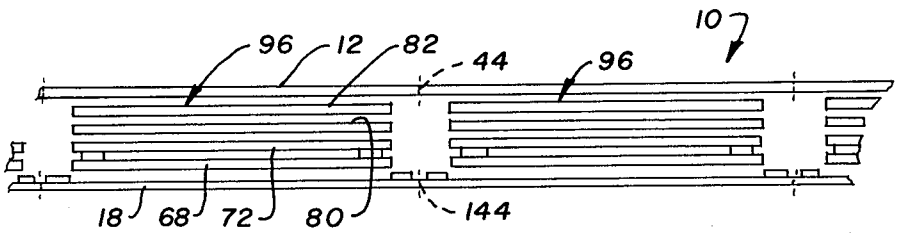
Figure 4:
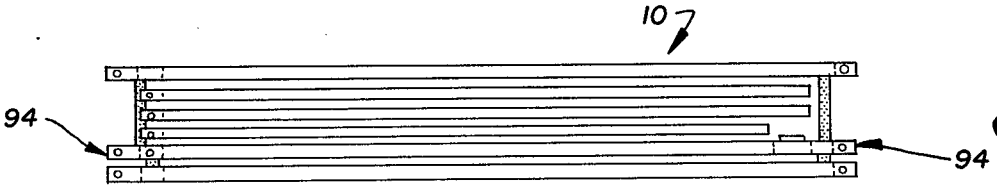
Figure 5:
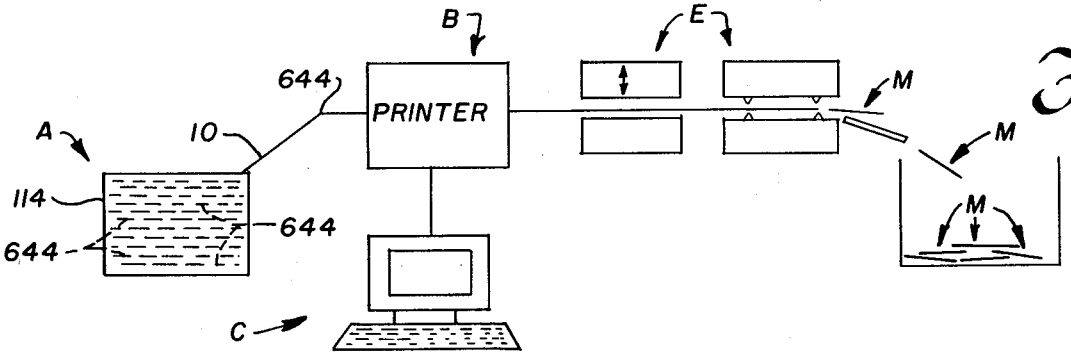
Figure 6:
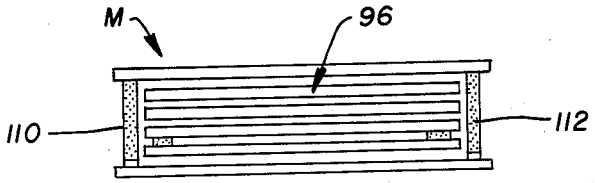

FIG. 1 is an exploded frontal perspective view of a single unit from the business form stock of the present invention;

FIG. 2 is an exploded rear perspective view thereof;

FIG. 3 is a fragmentary, thickness-exaggerated along-the-web (longitudinal) cross-sectional view of the business form stock of the present invention;

FIG. 4 is a fragmentary, thickness-exaggerated across-the-web (transverse) cross-sectional view thereof;

FIG. 5 is a schematic representation of a line for processing the business form stock of the present invention into individual personalized mailers; and FIG. 6 is a fragmentary, thickness-exaggerated along-the-web (longitudinal) cross-sectional view similar to FIG. 3, but of an individual mailer made from the business form stock of the present invention.

Figure 7:
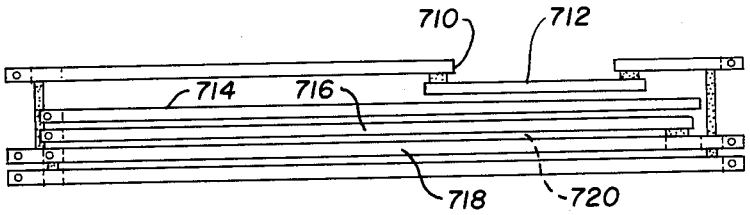

FIG. 7 is a fragmentary, thickness-exaggerated longitudinal cross-sectional view of a second embodiment of the business form stock of the present invention.

DETAILED DESCRIPTION

Referring first to FIGS. 1–4, the first embodiment of the business form stock 10 of the present invention is typically assembled from a longitudinally continuous (indeterminate length), full width top web 12, an intermediate sub-assembly 14 having longitudinally continuous lateral marginal portions 16 providing full width, and a longitudinally continuous, full width bottom web 18. The sub-assembly 14 is itself preferably assembled from a plurality of elements which will be further described hereinafter.

A full width web is e.g. 11.75 inches in width, and may be made of the same kind of paper as is conventionally used in the manufacture of web-type multiple-part business form stock, e.g. in the manufacture of Speediweb® form stock by Moore Business Forms, Inc.

In the instance depicted, the top web 12 is conventionally provided adjacent its laterally opposite edges 20, 22 with respective longitudinal rows of sprocket pin-receiving holes 24, 26. Somewhat more medially of the web 12 than the rows of holes 24, 26, the web 12 is shown conventionally provided with respective longitudinal perforation lines 28, 30. (By preference, the perforation lines are constituted by die-cut line segments alternated with uncut segments. However the term "perforation line" is used herein in its broadest sense, as a synonym for the term "line of weakness".) As is well-known in the trade, the strength of a line of weakness can be predetermined, e.g. by selecting the lengths of the cuts and the ratio of the cut segments to the uncut segments. In that regard, the lines of weakness 28, 30 are made to be relatively weak.

The lines of weakness 28, 30 define with the respectively closest edges 20, 22, marginal strips 32, 34 on intermediate regions of which the respective rows of sprocket holes 24, 26 are provided.

Inboard of the left line of weakness a second-stage marginal strip 36 is provided, defined at its lateral extreme by the line of weakness 28 and at its medial extreme by a further line of weakness 38. The latter is relatively stronger than the former so that a laterally outward tug on the marginal strips 32, 34 will, with a high degree of confidence, cause bursting along the lines of weakness 28, 30, while leaving the further line of weakness 38 temporarily intact.

The web 12 is shown further provided midway along the length of what will become each mailer, with a semicircular line of weakness 40, each having a radius of, e.g. one-half inch, and having its opposite ends coincident with the line of weakness 38. (The term "length" is used herein to designate the direction parallel to the longitudinal direction of the web, and without regard to whether the corresponding dimension of the layer, assembly or the like is longer or shorter than some other dimension, and without regard to whether printing, if on any face of any layer is right side up, upside down, or sideways in relation to such dimension. Further, the terms "top", "bottom", "left", "right", "vertical" and "horizontal" are used herein somewhat arbitrarily, using the FIG. 1 orientation of the product as a standard, and in the absence of any apparent necessity should not be understood to be required, or limitative in any sense.)

Longitudinally successive increments of the web 12 which will become parts of different individual mailers are delimited by successive respective across-the-web (transverse or horizontal) perforation lines 44 which extend from the left edge 20 to the right edge 22.

Each mailer increment of the web 12 is shown having various fields of non-variable printing provided on its outer face 46, i.e. printing that will remain the same for an entire composite web of business form stock, and very likely for many successively-used composite webs of the form stock used by the same business or other forms customer of a forms manufacturer.

Typical fields of non-variable printing on each mailer-increment of the outer face of the top web are, registration marks; form manufacturer's name, address and product number; patent notice; instructions for opening the outgoing envelope in order to gain access to the contents; a return address for the sender of the outgoing envelope; a pattern for obscuring the contents of the outgoing envelope; highlighting or outlining of use features, such as the semicircular line of weakness 40; a printed semicircular line 42, which is similar in size and appearance to the printed outline of the semicircular line of weakness 40, but is arranged with its ends against the line of weakness 30 at a position laterally aligned with a respective semicircular line of weakness 40; and outlining and/or an indication of the boundaries of one or more fields for receipt of variable information during forms processing, such as the space for the send-to address on the face of the outgoing envelope.

The inner face 48 of the outgoing envelope likewise may bear fields of non-variable printing. However, in the preferred embodiment, this surface is unprinted, in order to simplify manufacture of the forms by applying pre-printing to as few web faces as feasible, and having a minimum of web faces that need to be printed on two opposite faces.

In the preferred embodiment of FIGS. 1–4, the features 20–40 and 44 of the top web 12 are replicated in corresponding locations on the bottom web 18 so as to be substantially in registry therewith, feature for feature, thicknesswise of the composite web 10. Accordingly, the same numbers, raised by a factor of 100 are used for corresponding features, and their description is not repeated.

Although the bottom web likewise may be preprinted on either or both its outer face 50 and its inner face 52, in the preferred embodiment of FIGS. 1–4, neither face 50 nor 52 bears any pre-printing.

In the embodiment of FIGS. 1–4, the intermediate sub-assembly 14 comprises a plurality of layers which are regionally laminated together prior to the resulting sub-assembly being regionally laminated between the top web 12 and the bottom web 18 during manufacture of the form stock.

In this instance, the intermediate sub-assembly comprises as a lowermost layer a full-width continuous web 54.

This layer, which, in the preferred embodiment will form the front layer of a return envelope, is shown provided with features corresponding to features 20–38 and 44 of the top web 12, positioned so as to be located substantially in registry, feature-for-feature therewith, thicknesswise of the composite web 10. Accordingly, the corresponding features are indicated by the same numbers, raised by a factor of 200.

In addition, the web 54 is shown provided with a longitudinal row of sprocket holes 56 located on its second-stage left marginal strip 236 intermediate its lines of weakness 228 and 238, a second-stage right marginal strip 58 defined between its line of weakness 230 and a further longitudinal line of weakness 60 spaced inboard from the line of weakness 230, and a potential closure flap 62 for the potential return envelope, defined as a third-stage right marginal strip between the further line of weakness 60, and a longitudinal fold line 64 (which may be constituted by a perforation line). The web 54 has a first face 66 arranged to become the outer face of the return envelope, and a second face 68 arranged to become the inner face of the return envelope.

The inner face 68 is shown provided on the potential closure flap 62 with a longitudinally extending band 70 of rewettable glue (which, as in conventional, has been allowed to dry and become non-tacky before this layer of the form has been juxtaposed with the one whose surface will confront it in the composite web 10).

The outer face 66 of the web 54 is shown having been pre-printed with various fields of non-varying information, e.g. including a block for use by the sender of the return envelope to write-in his, her or its return address, a block indicating where postage is to be affixed, the name and address of the addressee to whom or to which the return envelope is to be delivered, and registration marks.

The inner face 68 of the web 54 is shown also having been pre-printed with various fields of non-varying information, e.g. including a pattern for obscuring the contents of the return envelope (and of the outgoing envelope), and registration marks.

Next uppermost to the continuous web 54 in the intermediate sub-assembly is a longitudinally discontinuous layer 72 which is the remainder of an originally continuous web (as will be further explained below). This layer 72 in the preferred embodiment will form the rear layer of the return envelope. This layer has a left edge 328 which corresponds to and is registered with the longitudinal rows of perforations 28, 128 and 228, and a right edge 74 which preferably is located slightly more medially of the composite web 10 than the fold line 64. The layer 72 is shown further provided with a row of sprocket holes 356, a left marginal strip 336 and a line of weakness 338 corresponding to and registered with the features 256, 236 and 238 of the continuous web 54.

The outer layer 76 of the layer 72 is shown bearing no pre-printing, and its inner layer 78 is shown printed with a contents-obscuring pattern, and registration marks.

The two remaining layers, 80, 82 of this embodiment also are artifacts of formerly continuous webs, as will be further explained below. The layer 82 is superimposed on the layer 80, one for providing a remittance slip and the other for providing a statement to be saved for the customer's own records.

These layers have left edges 428, 528 which correspond to and are registered with the elements 328, 28, 128 and 228, and right edges 460 and 560 which coincide with the element 60. Both of these layers are shown having back sides 84, 86 which preferably remain non-pre-printed, and front faces 88, 90 which are shown pre-printed with non-varying tabulation grids, e.g. sets of cells into which varying data will be printed during forms processing, various insructions (e.g. that the customer should keep one sheet and return the other in the return envelope with a check for the variable print-indicated amount due), space 93 for a customer's name and postal address, and registration marks.

The intermediate sub-assembly is assembled by providing respective webs, guiding them using the sprocket holes provided along one or both lateral margins of each, applying glue, where indicated, regionally adhering the layers of the intermediate subassembly together and die-cutting out a transversely broad and longitudinally narrow, generally rectangular slot 92, so as to leave left and right lateral marginal bridge portions 94 connecting composite regionally laminated elements of the intermediate sub-assembly 14 to one another, so that the sub-assembly, 14 resembles a ladder, of which the successive sets 96 of regionally laminated elements are the "rungs". The slot 92 and its role are further described below.

As the intermediate sub-assembly 14 is assembled from respective continuous webs, while these webs are coordinately guided using the rows of sprocket holes provided on the lateral marginal strips of the respective webs, adhesive is applied for regionally bonding these webs facewise to one another and then the glued webs are pressed together to form the intermediate sub-assembly 14.

As is conventional, any time a glue line is to be provided, it may be provided on either or both of the two surfaces it is intended to adhere together, and that line may be constituted by one or more continuous lines, narrow or broad, continuous or discontinuous (e.g., by a pattern of glue dots). A wide range of adhesives may be used, as is conventional, although use of what is termed a "cold glue" (a conventional product) is preferred. A cold glue need not be heated to activate it; it is simply applied wet, and the two surfaces which are to be stuck together are pressed together while the cold glue is in a sufficiently tacky state.

With the foregoing in mind, the intermediate sub-assembly 14 is shown regionally bonded together by a squared U-shaped glue strip 94 running along the top, left and bottom margins of each portion of the lowermost web that will become the inner face of a return envelope, i.e. to the right of the left secondary marginal strip and to the left of the glue flap fold line. The left secondary marginal strip is provided with a longitudinal glue line 96 for adhering this strip to the corresponding strip of the next-uppermost layer.

The next-uppermost layer is the one that forms the backs of the return envelopes. It is provided with a longitudinal glue line 98 on its left secondary marginal strip for adhering this strip to the corresponding strip of the next-uppermost layer.

The next-uppermost layer is the one that forms the remittance slips. It is provided with a longitudinal glue line 100 on its left secondary marginal strip for adhering this strip to the corresponding strip of the next-uppermost layer, namely the one which provides the customer's copy of the statement.

All of the layers of the sub-assembly are pressed together while the glue lines 94–100 remain active, so that the respective elements will be regionally bonded to one another, as has been described.

The assembly of the product 10 is completed by regionally applying adhesive to the top, intermediate and bottom webs 12, 14, 18 and guiding them into a pressed-together stacked relationship while the glue which regionally holds these webs together remains tacky. These glue lines respectively comprise glue lines 102, 104 streamed longitudinally onto the inner face of the bottom web 18 immediately inboard of the left and right rows of perforations 28, 30, and glue lines 106, 108 streamed longitudinally onto a corresponding location on the resulting composite after the intermediate sub-assembly 14 has been glued by the glue lines 102, 104 to the inside of the back of the outgoing envelope. The glue lines 106, 108 glue the top web of the form stock 10 to the pre-assembled assembly of the other webs.

In this type of product, it would be conventional to also glue the inside faces of the fronts and backs of the outgoing envelopes to one another along respective transverse glue lines located closely adjacent each side (i.e., above and below) each transverse line of weakness 44. But, when following the practice of the present invention, that conventional practice is deviated from. Rather, at the same locations, at least one of the confronting faces, along both upper and lower margins, is provided with a strip 110, 112 of heat-activated adhesive which is allowed to cool and become non-tacky before the webs 12, 14 and 18 are pressed together to unite them. Accordingly, in antithetical contrast to conventional practice, the corresponding upper and lower margins of the potential outgoing envelopes are left glue-bearing, but non-adhered to one another. The glue used for these strips 110, 112 may be a conventional heat-activated (hot melt) adhesive.

Before passing on to a description of FIGS. 5, and following, it should be noticed that the slots, which are conventionally die-cut from the intermediate sub-assembly after the latter has been assembled and regionally bonded together, is so wide, transversally of the webs, that its lateral edges coincide with the lines of weakness 28, 30 which define medial edges of the marginal strips 32, 34. Longitudinally of the webs, the slots are centered on the transverse lines of weakness 244, 344, 444, 544, so that only small vestiges of these elements remain (on the lateral marginal portions 16). The upper and lower edges of the slots are positioned to expose the glue strips 110, 112 on the inner face of the bottom 118 web to the corresponding surface regions of the inner face of the top web 12, in the regions between the left and right ends of the slots, after the composite web 10 has been assembled.

In the preferred practice, after the product 10 has been manufactured, it is Z-folded on the superimposed transverse fold lines 644 after every X number of mailer increments (where X is a small integer, typically two, but alternatively one, three, four or more) and packed in a box 114 so as to fill the box. The box of multiple-part composite web-type business form stock is then shipped (delivered, transferred) to the customer's forms processing department or facility (which may be a service organization contracted to the customer, and, at times, may be a service organization affiliated with the manufacturer of the form stock).

The processing which typically is accomplished on the customer's forms processing line is schematically depicted in FIG. 5.

At A, a carton of form stock is opened and the leading end of the composite web 10 contained in the box is fed into the conventional tractors of an impact-type printer at B. The printer at B is operatively connected with and its operation is controlled by a computer at C, which controls the printer to apply by impact-type printing variable information onto each successive increment of the form stock. After the printing of each increment is completed, the printer tractors advance the composite web so as to position a succeeding increment in the printer for receiving variable printing of data which is stored in the computer, and/or may be keyboarded on-line by a human operator. For some of the information, the printer may use a conventional inking ribbon interposed between its hammers and the top layer of the composite web, e.g. so as to print a corresponding send-to address externally on the outgoing envelope. For other elements of the information being variably printed, the inking ribbon may be shifted out of the way and not used, so that the variable information becomes printed at various sites within the respective potential outgoing envelope, on one or more layers of the intermediate sub-assembly 14. This printing may be accomplished in any convenient manner, preferably by having conventionally provided carbonless impact-sensitive copy-making coating on one or more of the layer surface disposed within each potential outgoing envelope. Such coatings typically would be provided on the webs as the webs were manufactured or on the webs before the webs were laminated with one another. In conventional practice, which can be followed in the present instance, some impact-sensitive carbonless copying coatings are self-contained, in the sense that everything necessary to cause the copy to appear, except the impact, is coated onto one surface of one sheet. And in other conventional practice, which can be followed in the present instance, the impact-sensitive carbonless copying coatings are provided in sets of complementary coatings each containing some of the essential ingredients, some in one coating on one face of one sheet, and the remainder in another coating on a confronting face of another sheet.

After the variable printing has been accomplished, the variably printed composite web 10 is led through a succession of further stations E, or a lesser number of combined-function further stations, in which the composite web is pressed thicknesswise between heated platens so as to activate the heat-activated adhesive in the strips 110 and 112 thus causing the succession of potential outgoing envelopes to become sealed along their upper and lower margins, the composite marginal strips 32, 132, 232 at the left and 34, 134, 234 at the right are burst-away from the resultingly narrowed composite web along the perforation lines 28, 128, 228 and 30, 130, 230, and the narrowed composite web is burst cross-wise into a succession of individual mailers M all sealed, addressed and ready to mail (FIG. 6).

The modified embodiment which is depicted in FIG. 7 differs from the one which has been described in relation to FIGS. 1–6 in respect to features which are not themselves novel for conventional factory-sealed mailer stock. For instance, the outgoing envelope is windowed at 710, so that the outoing send-to address can be impact printed without using an inking ribbon, due to a carbonless coating being provided on at least one of the inner surface of the glassine patch 712 with which the window is conventionally glazed and the facing sheet surface within the envelope. Also in this embodiment, the layers of the intermediate sub-assembly are reduced by one, by using laterally adjoining layers 714, 716 of one sheet as the statement and remittance stub, rather than providing the respective functions on different sheets. And the return envelope 718 is one which closes along a transverse edge at 720, rather than at one end. Yet other variations are possible and other elaborations known in the art can be used.

Other conventional practices may be followed, e.g. a temporary fly sheet in the form of a removable ply (not shown) mechanically connected to the other plies, e.g. by partially cut crimps in the outer marginal strips, may be provided as a part of the composite web 10, this sheet to be temporarily juxtaposed with, e.g. the front of the outgoing envelope, but removed at an appropriate stage in the process depicted in FIG. 6.

It should now be apparent that the web-type multiplepart business form stock having pre-glued but non-adhered crossweb heat seal glue lines designed for activation to seal outgoing envelopes after printing-type personalization of potential forms thereof as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A web-type multiple-part business form stock, comprising:

two relatively outer webs having inner faces and outer faces and an indeterminate length in a logitudinal direction;

correspondingly-placed transverse lines of weakness provided in said two relatively outer webs for dividing said relatively outer webs into a corresponding succession of envelope fronts and envelope backs;

each said relatively outer web including at least one marginal strip means provided with a row of drivable elements for use in advancing the respective web longitudinally in a uniform manner, and a longitudinal line of weakness extending between said row of drivable elements and a medial portion of major transverse extent of the respective said web, whereby, after use, the respective said row of drivable elements may be severed from said medial portion along the respective said longitudinal lines of weakness;

at least one field designated on an outer face of at least one of said relatively outer webs, on said medial portion thereof, for reception of strikings of an impact printer for printing variable information thereon or therethrough;

two longitudinal glue line means gluing said inner faces of said two outer webs to one another along respective sites which are spaced transversally from one another and located more medially of the respective said outer webs than the respective said marginal strip means so as to define left and right ends for a succession of potential envelopes; and disposed longitudinally between each of said transverse lines of weakness, at least one strip of non-active heat-activatable adhesive applied to a respective one of said inner faces of at least one of said two outer webs so as to extend transversally thereof between said two longitudianl glue line means, each said strip of non-active heat-activatable adhesive being free of adhesive securement to the respective other of said inner faces, but disposed to be securable thereto upon heat-activation of said heat-activatable adhesive, whereby said inner faces of said two outer webs may be left unconnected by said strips of non-active heat-activatable adhesive between said two longitudinal glue line means, until after variable information has been impact printed on said at least one field, for therby reducing printing problems associated with form stock tenting and air entrapment.

2. The web-type multiple-part business form stock of claim 1, wherein:

said at least one strip of non-active heat-activatable adhesive is constituted by two longitudinally spaced such bands, each disposed to provide, upon activation, a corresponding edge of an internal space of a respective potential envelope.

3. The web-type multiple-part business form stock of claim 2, further including:

an intermediate sub-assembly disposed intermediate said two relatively outer webs in a thicknesswise sense, so as to include at least one layer of sheet material located between said medial portions of said two relatively outer webs in a thicknesswise sense and longitudinally between each set of said two longitudinally spaced strips of non-activated heat-activatable adhesive.

4. The web-type multiple-part business form stock of claim 3, wherein:

said one layer of sheet material between each set of said two longitudinally spaced strips of non-activated heat-activatable adhesive bears at least one field of printing which varies in informational content from all others of said one layers of said sheet material on a composite web of indeterminate length of said web-type multiple-part business form stock.

5. The web-type multiple-part business form stock of claim 4, wherein:

said one field of printing is a field of impact printing applied through one of said two relatively, outer webs.

6. The web-type multiple-part business form stock of claim 5, wherein:

at least one of a face of each said one layer of sheet material and a face of a layer of sheet material means facing said one layer bears a coating of impact-sensitive copy-making composition.

7. The web-type multiple-part business form stock of claim 6, wherein:

said impact-sensitive copy-making composition is an impact-sensitive carbonless copy-making coating.

8. The web-type multiple-part business form stock of claim 3, wherein:

said intermediate sub-assembly is of indeterminate length along left and right margins thereof, but provided with a series of longitudinally spaced medial slots through which said strips of non-activated heat-activatable adhesive are exposed to the inner face of the other of said two relatively outer webs relative to the respective inner face on which such strips are provided.

9. The web-type multiple-part business form stock of claim 8, wherein:

said at least one layer of sheet material comprises a plurality of layers of sheet material.

10. The web-type multiple-part business form stock of claim 9, wherein:

said at least one layer of sheet material comprises a respective succession of potential return envelopes and a respective succession of elements of at least one additional layer which is pre-printed to serve as at least one of a statement and a remittance slip.

11. A method for processing a web-type multiple-part business form stock into a succession of individualized separate mailers, comprising:

providing a web-type multiple-part business form stock as a coposite web of indeterminate length, which composite web includes:

two relatively outer webs having inner faces and outer faces and an indeterminate length in a longitudinal direction;

correspondingly-placed transverse lines of weakness provided in said two relatively outer webs for dividing said relatively outer webs into a corresponding succession of envelope fronts and envelope backs;

each said relatively outer web including at least one marginal strip means provided with a row of drivable elements for use in advancing the respective web longitudinally in a uniform manner, and a longitudinal line of weakness extending between said row of drivable elements and a medial portion of major transverse extent of the respective said web, whereby, after use, the respective said row of drivable elements may be severed from said medial portion along the respective said longitudinal lines of weakness;

at least one field designated on an outer face of at least one of said relatively outer webs, on said medial portion thereof, for reception of strikings of an impact printer for printing variable information thereon or therethrough;

two longitudinal glue line means gluing said inner faces of said two outer webs to one another along respective sites which are spaced transversally from one another and located more medially of the respective said outer webs than the respective said marginal strip means so as to define left and right ends for a succession of potential envelopes; and disposed longitudinally between each of said transverse lines of weakness, at least one strip of non-active heat-activatable adhesive applied to a respective one of said inner faces of at least one of said two outer webs so as to extend transversally thereof between said two longitudinal glue line means, each said strip of non-active heat-activatable adhesive being free of adhesive securement to the respective other of said inner faces, but disposed to be securable thereto upon heat-activation of said heat- activatable adhesive;

Z-folding said composite web along a regular succession of at least some of said transverse lines of weakness;

transporting said composite web from one physical location to another while said composite web is so-folded;

at said other physical location, beginning with a leading end of said composite web, progressively unfolding said composite web and feeding the unfolded composite web progressively through a variable printing station in which at least one field of unique information is printed on said composite web between each longitudinally neighboring two of said transverse lines of weakness;

heating a moving segment of said composite web in or downstream of said variable printing station for activating said non-activated heat-activatable adhesive for adhering said two relatively outer webs to one another along said strips of non-active heat-activatable adhesive; and progressively severing said composite web at or downstream of said segment, along said transverse lines of weakness, into a succession of individual mailers.

12. The method of claim 11, wherein:

said at least one strip of non-active heat-activatable adhesive is constituted by two longitudinally spaced such bands, each disposed to provide, upon activation, a corresponding edge of an internal space of a respective potential envelope.

13. The method of claim 12, wherein:

said composite web as provided in said providing step further includes:

an intermediate sub-assembly disposed intermediate said two relatively outer webs in a thicknesswise sense, so as to include at least one layer of sheet material located between said medial portions of said two relatively outer webs in a thicknesswise sense and longitudinally between each set of said two longitudinally spaced strips of non-activated heat-activatable adhesive; and said unique information is provided on said at least one layer of sheet material by impact printing through at least one of said two relatively outer webs.

14. The method of claim 13, wherein:

said unique information is provided by indirectly impacting a coating of impact-sensitive carbonless copying material provided between said two relatively outer webs.

* * * * *